US007260883B2

(12) United States Patent
Younger et al.

(10) Patent No.: US 7,260,883 B2
(45) Date of Patent: Aug. 28, 2007

(54) METHOD FOR FORMING A WINDING FOR A THREE-PHASE TRANSFORMER

(75) Inventors: Harold R. Younger, Halifax, VA (US); Egil Stryken, Solbergelva (NO); John Wallumrod, Hof (NO)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 10/600,676

(22) Filed: Jun. 19, 2003

(65) Prior Publication Data

US 2004/0257188 A1 Dec. 23, 2004

(51) Int. Cl.
*H01F 7/06* (2006.01)

(52) U.S. Cl. ..... 29/602.1; 29/605; 29/606; 336/182; 336/206

(58) Field of Classification Search ..... 29/602.1, 29/606, 605, 868, 871, 33 L; 336/182, 199, 336/221, 206; 140/93 R, 105
See application file for complete search history.

(56) References Cited

U.S. PATENT DOCUMENTS 2,559,824 A * 7/1951 Leland ..... 29/605 X
3,368,176 A * 2/1968 Rechel ..... 29/605 X
3,504,431 A * 4/1970 Schwenker et al. ..... 29/605
4,521,954 A * 6/1985 Rademaker et al. ..... 29/605
6,216,513 B1 4/2001 Nakamura et al. ..... 72/148
2001/0005934 A1 7/2001 Nakamura et al. ..... 29/605

FOREIGN PATENT DOCUMENTS

JP 3-70109 * 3/1991 ..... 29/605 X

* cited by examiner

*Primary Examiner*—A. Dexter Tugbang
(74) *Attorney, Agent, or Firm*—Paul R. Katterle

(57) ABSTRACT

A preferred embodiment of a three-phase transformer includes a first, a second, and a third winding leg, and a first, a second, and a third winding positioned around the respective first, second, and third winding legs. The first, second, and third windings each includes an electrical conductor wound into a plurality of overlapping layers each formed by a plurality of adjacent turns of the electrical conductor, and an insulating material without end fill positioned between each of the overlapping layers. The electrical conductor has a transition portion formed therein between a first and a second of the overlapping layers. The transition portion is at least one of bent to form an offset in the electrical conductor, and secured to at least one of the plurality of adjacent turns.

11 Claims, 7 Drawing Sheets

METHOD FOR FORMING A WINDING FOR A THREE-PHASE TRANSFORMER

FIELD OF THE INVENTION

The present invention relates generally to transformers used for voltage transformation, and more particularly to three-phase transformers.

BACKGROUND OF THE INVENTION

Three-phase transformers typically include a magnetic core, and three sets of high and low-voltage windings (coils). Each set of high and low-voltage windings is mounted on a respective winding leg of the core.

The windings are typically formed by winding an electrical conductor, such as copper or aluminum wire, on a continuous basis. The electrical conductor can be wound around a mandrel or directly onto an associated winding leg of the transformer. The electrical conductor is wound into a plurality of turns in side by side relationship to form a first layer of turns. A first layer of insulating material is subsequently placed around the first layer of turns. The electrical conductor is wound into a second plurality of turns over the first layer of insulating material, thereby forming a second layer of turns.

A second layer of insulating material is subsequently placed over the second layer of turns. The electrical conductor is then wound into a third plurality of turns over the second layer of insulation, thereby forming a third layer or turns. The above procedures can be repeated until a predetermined number of turn layers have been formed.

The insulating material is typically formed as a sheet or a continuous strip. The insulating material usually includes end fill, i.e., filling material bonded or otherwise secured to opposing sides of the sheet or strip. For example, FIG. 8 depicts a portion of a transformer winding 99 formed using conventional techniques. The transformer winding 99 comprises sheets of insulating material 100 that each include end fill 101, and an electrical conductor 106 wound in layers 108 each formed by a plurality of turns of the electrical conductor 106.

End fill is believed to increase the short-circuit strength of the transformer winding, and can thereby decrease the potential for short-circuit failure. End fill can also inhibit the tendency for the outermost turns of each layer to separate from their adjacent turns and drop down from their respective underlying layers of turns. In other words, the end fill can have a restraining effect that counteracts the tendency of the outermost turns to move outwardly, away from the remaining turns in their respective layers.

The use of end fill can add to the cost of the insulating material (and the overall cost of the transformer winding), can increase the space needed to store the insulating material, and can adversely affect manufacturability of the transformer winding, in comparison to windings formed with insulation that does not include end fill. Moreover, the use of end fill can make it difficult to automate the winding process. The use of insulation with end fill, until recently, was generally considered a necessity in three-phase transformers due to the relatively high kva ratings (50 kva and higher) associated with such transformers (high kva ratings generally necessitate high short-circuit strength). Also, the use of insulation with end fill is often considered necessary to inhibit the tendency of the outermost turns of the transformer winding to separate from their adjacent turns and drop down from their underlying layers, as discussed above.

SUMMARY OF THE INVENTION

A preferred embodiment of a three-phase transformer comprises a first, a second, and a third winding leg, and a first, a second, and a third winding positioned around the respective first, second, and third winding legs. The first, second, and third windings each comprise an electrical conductor wound into a plurality of overlapping layers each formed by a plurality of adjacent turns of the electrical conductor, and an insulating material without end fill positioned between each of the overlapping layers. The electrical conductor has a transition portion formed therein between a first and a second of the overlapping layers. The transition portion is at least one of bent to form an offset in the electrical conductor, and secured to at least one of the plurality of adjacent turns.

A preferred method for forming a transformer winding comprises winding an electrical conductor into a first plurality turns in side by side relationship to form a first layer of turns, covering at least a portion of the first layer of turns with a layer of insulating material without end fill, and winding the electrical conductor into a second plurality turns in side by side relationship to form a second layer of turns that overlies the first layer of turns and the layer of insulation. The preferred method also comprises at least one of bending the electrical conductor to form an offset in the electrical conductor at a transition in the electrical conductor between the first layer of turns and the second layer of turns, and securing the transition in the electrical conductor to at least one of the first plurality of turns. The electrical conductor is one of wound into the first and second pluralities of turns over a winding leg of a core of the three-phase transformer, and wound into the first and second pluralities of turns over a mandrel and subsequently installed on the winding leg.

Another preferred method for forming a transformer winding comprises winding an electrical conductor into a first plurality turns in side by side relationship to form a first layer turns, and bending a first portion of the electrical conductor upwardly and laterally in relation to the first layer of turns so that a second portion of the electrical conductor immediately following the first portion of the electrical conductor overlies the first layer of turns. The preferred method also comprises subsequently winding the electrical conductor into a second plurality turns in side by side relationship to form a second layer of turns. The electrical conductor is one of wound into the first and second pluralities of turns over a winding leg of a core of the three-phase transformer, and wound into the first and second pluralities of turns over a mandrel and subsequently installed on the winding leg.

BRIEF DESCRIPTION OF THE DRAWINGS

The foregoing summary, as well as the following detailed description of a preferred method, is better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DESCRIPTION OF PREFERRED EMBODIMENTS

Figure 1:
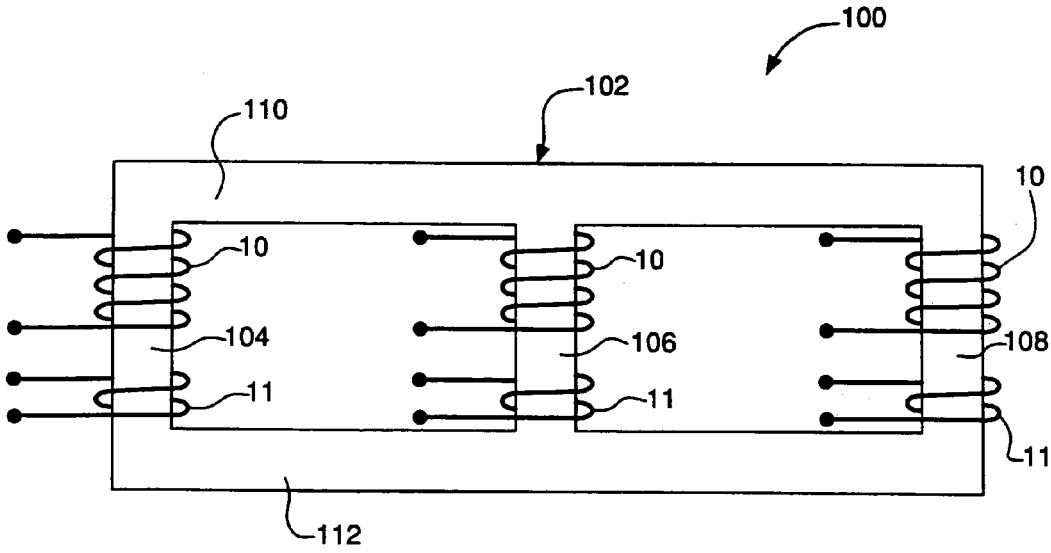
FIG. 1 is a side view of a preferred embodiment of a three-phase transformer.

A preferred embodiment of a three-phase transformer 100 is depicted in FIG. 1. The transformer 100 comprises a conventional laminated core 102. The core 102 is formed from a suitable magnetic material such as textured silicon steel or an amorphous alloy. The core 102 comprises a first winding leg 104, a second winding leg 106, and a third winding leg 108. The core 102 also comprises an upper yoke 110 and a lower yoke 112. Opposing ends of each of the first, second, and third winding legs 104, 106, 108 are fixedly coupled to the upper and lower yokes 110, 112 using, for example, a suitable adhesive.

A primary winding 10 is positioned around each of the first, second, and third winding legs 104, 106, 108. A secondary winding 11 is likewise positioned around each of the first, second, and third winding legs 104, 106, 108. The primary windings 10 can be electrically connected in a "Delta" configuration, as is commonly known among those skilled in the art of transformer manufacturing and design. The secondary windings 11 can be electrically connected in a "Delta" or a "Wye" configuration, depending on the voltage requirements of the transformer 100. (The electrical connections between the primary and secondary windings 10, 11 are not shown in FIG. 1, for clarity.)

The primary windings 10 can be electrically coupled to a three-phase power source (not shown). The secondary windings 11 can be electrically coupled to a load (also not shown). The primary and secondary windings 10, 11 are inductively coupled via the core 102 when the primary windings 10 are energized by the load. More particularly, the alternative voltage across the primary windings 10 sets up an alternating magnetic flux in the core 102. The magnetic flux induces an alternating voltage across the secondary windings 11 (and the load connected thereto).

A description of additional structural elements and functional details of the transformer 10 is not necessary to an understanding of the present invention, and therefore is not presented herein.

A description of a preferred method for forming one of the primary windings 10 follows (the preferred method is equally applicable to the secondary windings 11). The primary winding 10 is depicted herein a being cylindrical. The preferred method can also be applied to windings formed in other shapes, such as round, rectangular, rectangular with curved sides, oval, etc.

Figure 2:
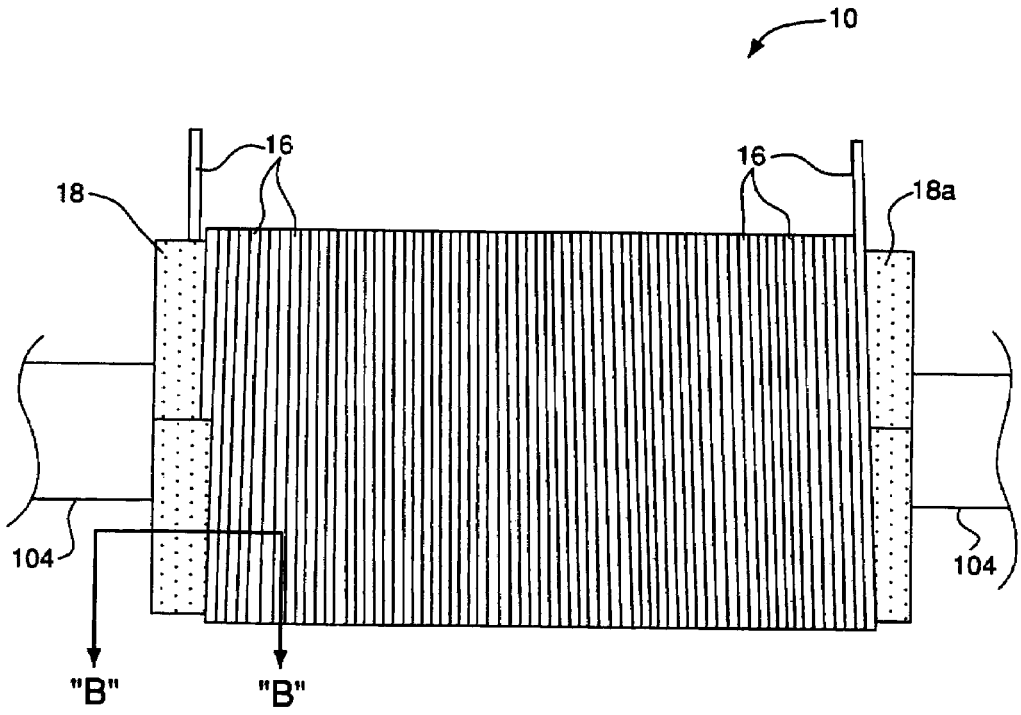
FIG. 2 is a side view of a winding of the transformer shown in FIG. 1.

The primary winding 10 is described as being wound directly onto the winding leg 104 of the transformer 100 (see FIG. 2). The preferred method can also be used to form the primary winding 10 on a mandrel for subsequent installation on the winding leg 104. The preferred method can also be applied to non-concentric primary and secondary windings.

Figure 3:
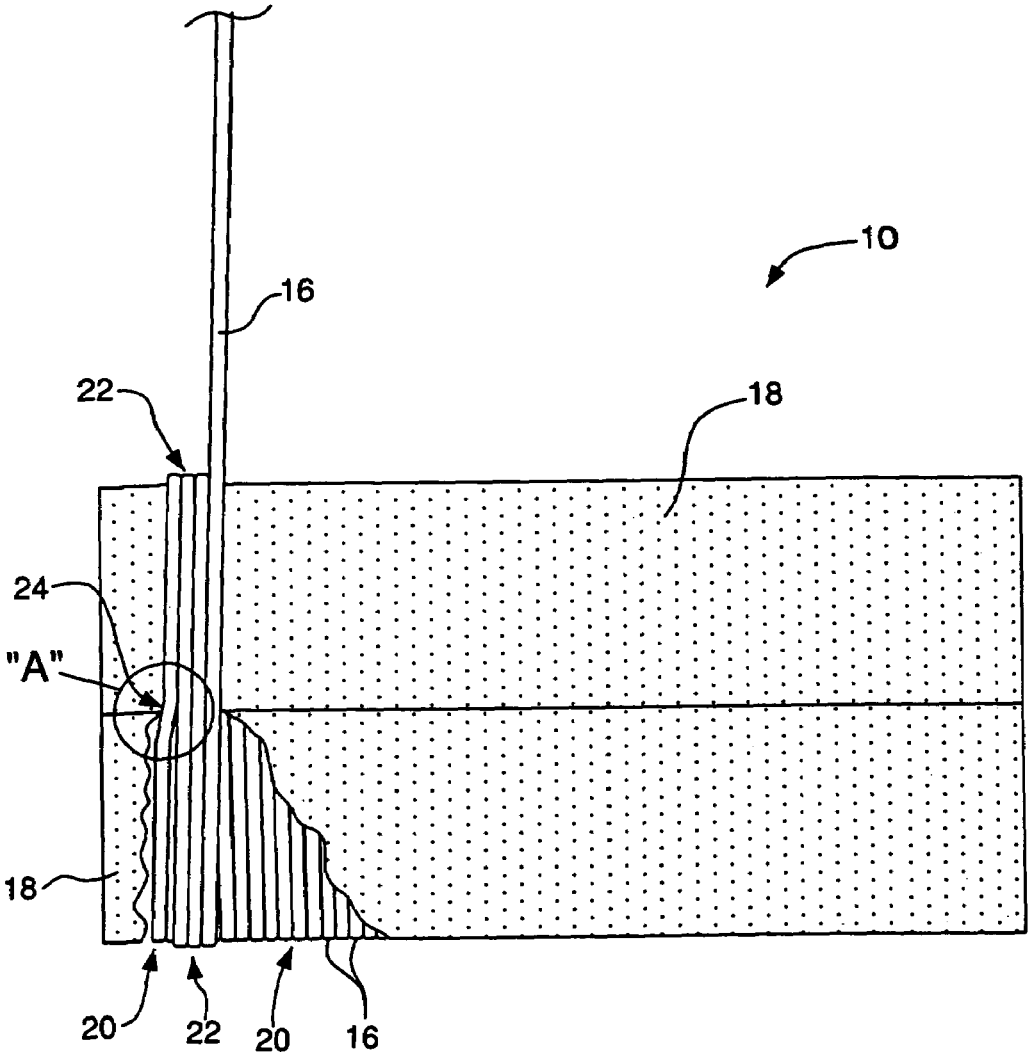
FIG. 3 is a side view of the winding shown in FIG. 2, as a second layer of turns of the winding is being wound, and showing a sheet of insulation of the winding in cutaway to reveal a first layer of turns of the winding.

The primary winding 10 comprises an electrical conductor 16 wound around the winding leg 104 on a continuous basis (see FIG. 2). The electrical conductor 16 can be, for example, rectangular, round, or flattened-round aluminum or copper wire. (Other types of electrical conductors, including electrical conductors having non-circular cross sections, can be used in the alternative). The primary winding 10 also comprises face-width sheet layer insulation. More particularly, the primary winding 10 comprises sheets of insulation 18 (see FIGS. 2, 3, and 5). The sheets of insulation 18 can be formed from heat-curable epoxy diamond pattern coated kraft paper (commonly referred to as "DPP paper"). It should be noted that other types of insulation, such as heat-curable epoxy fully coated kraft paper or coated crepe paper, can be used in the alternative. The sheets of insulation 18 do not include end fill.

The primary winding 10 comprises overlapping layers of turns of the electrical conductor 16. A respective one of the sheets of insulation 18 is positioned between each of the overlapping layers of turns (see FIG. 5). The turns in each layer advance progressively across the width of the primary winding 10. In other words, each overlapping layer of the primary winding 10 is formed by winding the electrical conductor 16 in a plurality of turns arranged in a side by side relationship across the width of the primary winding 10.

The primary winding 10 is formed by placing one of the sheets of insulation 18 on an outer surface of the first winding leg 104 so that the sheet of insulation 18 covers a portion of the outer surface.

A first layer of turns 20 is subsequently wound onto the winding leg 104. More particularly, the electrical conductor 16 is wound around the outer surface of the winding leg 104 and over the sheet of insulation 18, until a predetermined number of adjacent (side by side) turns have been formed.

A transition from the first layer of turns 20 to an overlying second layer of turns 22 can be formed by bending the electrical conductor 16. More particularly, an offset or bend 24 can be placed in the electrical conductor 16 at the end of the first layer of turns 20, i.e., in the portion of the electrical conductor 16 that transitions, or crosses over from the first layer of turns 20 to the second layer of turns 22 (see FIGS. 3, 4, 6, and 7; the sheets of insulation 18 are not shown in FIG. 4, for clarity). (The term "bending," as used in this context throughout the specification and claims, means permanently (non-resiliently) deforming the electrical conductor 16.)

Figure 4:
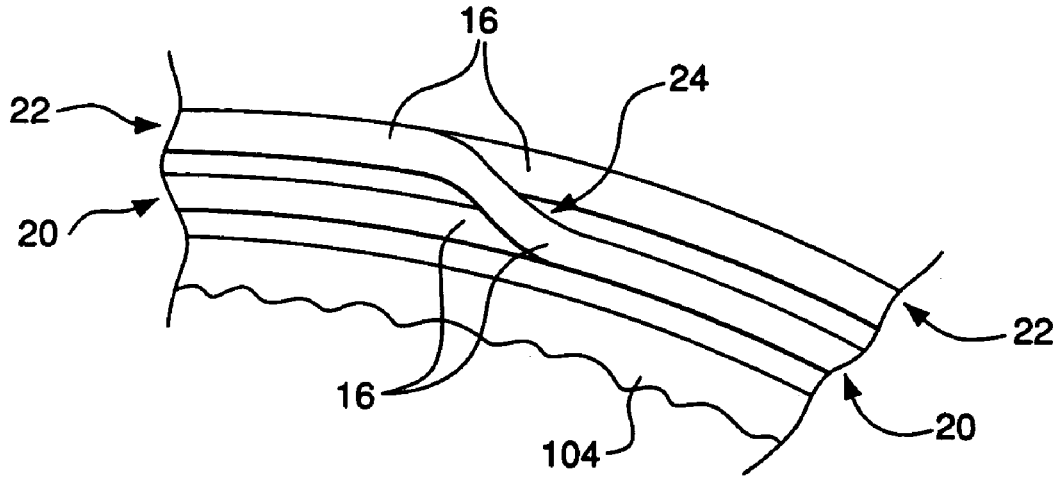
FIG. 4 is a magnified view of the area designated "A" in FIG. 3, from a perspective rotated ninety degrees from the perspective of FIG. 3.

The bend 24 extends upwardly, i.e., away from the underlying surface of the first winding leg 104 (see FIG. 4). The bend 24 also extends laterally in relation to the first layer of turns 20, i.e., in a direction coinciding with the longitudinal axis of the first winding leg 104 (see FIG. 3). The bend 24 thus causes the subsequent portion of the electrical conductor 16 to be positioned above the first layer of turns 20. The use of the bend 24 to transition the electrical conductor 16 from the first layer of turns 20 to the second layer of turns 22 is believed to lessen the potential for the outermost turns of the second layer of turns 22 proximate the bend 24 to separate from their adjacent turns and drop down from their position above the first layer of turns 20. (Lessening the potential for the outermost turns of the primary winding 10 to separate from their adjacent turns, as explained below, can facilitate the use of insulation without end fill.)

It should be noted that the angle at which the electrical conductor 16 is bent to form the bend 24 depends on factors such as the diameter of the electrical conductor 16, the overall size of the primary winding 10, the circumferential location of the bend 24 on the primary winding 10 (which in turn can depend on the shape of the primary winding 10), etc. A specific value for this angle therefore is not specified herein.

Figure 6:
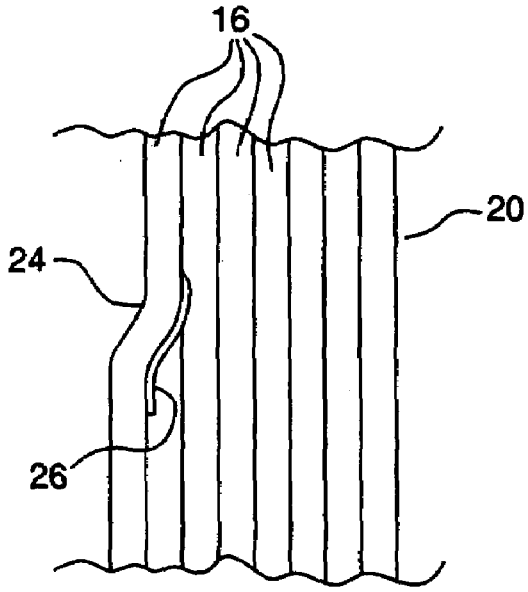
FIG. 6 is a side view of the first layer of turns shown in FIG. 3, showing a mechanical joint for securing a transition between the first and second layers of turns shown in FIG. 3 to the first layer of turns.
Figure 7:
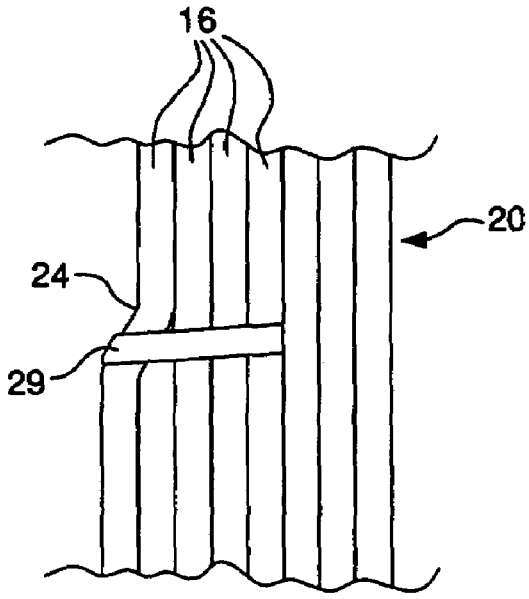
FIG. 7 is a side view of the first layer of turns and the transition shown in FIGS. 3 and 6, with a ribbon installed on the transition and the first layer of turns to secure the transition to the first layer of turns.
Figure 8:
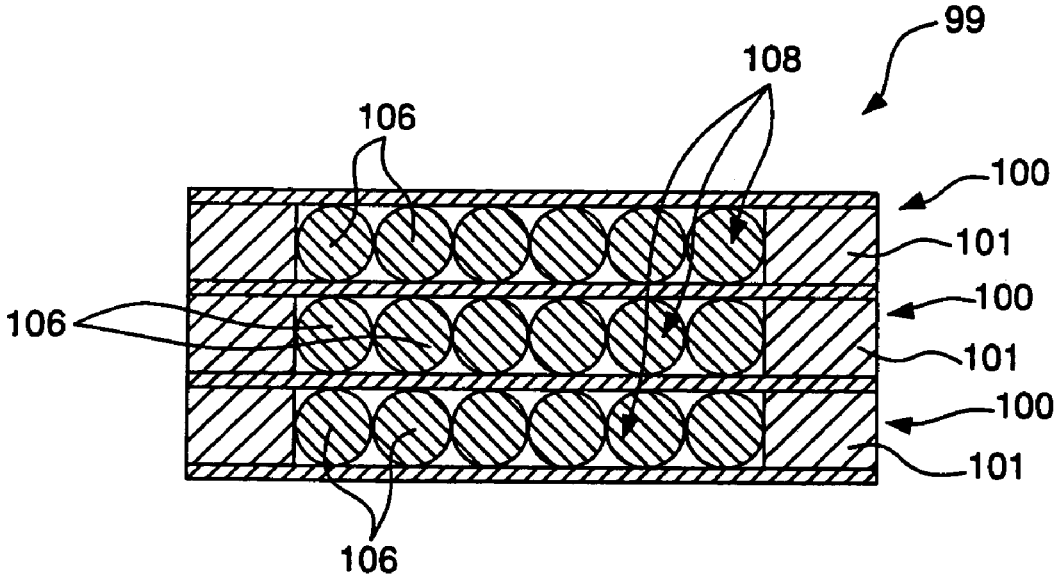
FIG. 8 Prior Art
FIG. 8 is a cross-sectional view of a transformer winding formed using conventional techniques, the transformer winding comprising insulation that includes end fill.

A suitable adhesive, such as hot melt adhesive, can be applied to the portion of the electrical conductor 16 that transitions between the first layer of turns 20 and the second layer or turns 22. More particularly, the adhesive can be applied to the bend 24, and to the portion of the electrical conductor 16 immediately preceding and immediately following the bend 24. The adhesive can also be applied to the portion of the first layer of turns 20 adjacent the bend 24. The adhesive, upon drying, forms a mechanical joint 26 that can secure the bend 24 to the adjacent portion of the first layer of turns 20 (the joint 26 is shown in FIG. 6 only, for clarity). The joint 26 is believed to lessen the potential for the outermost turns of the second layer of turns 22 proximate the bend 24 to separate from their adjacent turns.

It should be noted that the technique of applying adhesive to the portion of the electrical conductor 16 that transitions between the first layer of turns 20 and the second layer of turns 22 can be used in alternative versions of the preferred method in which the bend 24 is not formed in the electrical conductor 16.

The second layer of turns 22 is formed after the transition from the first to the second layers 20, 22 has been formed in the above-described manner. In particular, another of the sheets of insulation 18 is secured in place over the first layer of turns 20 so that an edge of the sheet of insulation 18 is located proximate the bend 24, and extends across the first layer of turns 20 (see FIG. 3).

The electrical conductor 16 is subsequently wound over the first layer of turns 20 and the overlying sheet of insulation 18 to form the second layer of turns 22, in the manner described above in relation to the first layer of turns 20. In other words, the second layer of turns 22 is formed by winding the electrical conductor 16 into a series of adjacent turns progressing back across the first layer of turns 20, until a predetermined turns count is reached.

A transition between the second layer of turns 22 and an overlying third layer of turns 23 is formed after the second layer of turns 22 has been wound, in the manner described above in relation to the transition between the first and second layers 20, 22. Another of the sheets of insulation 18 is subsequently positioned around the second layer of turns 22. The electrical conductor 16 is then wound into a series of adjacent turns progressing across the width of the sheet of insulation 18 and the second layer of turns 22, thereby forming the third layer of turns 23.

Figure 5:
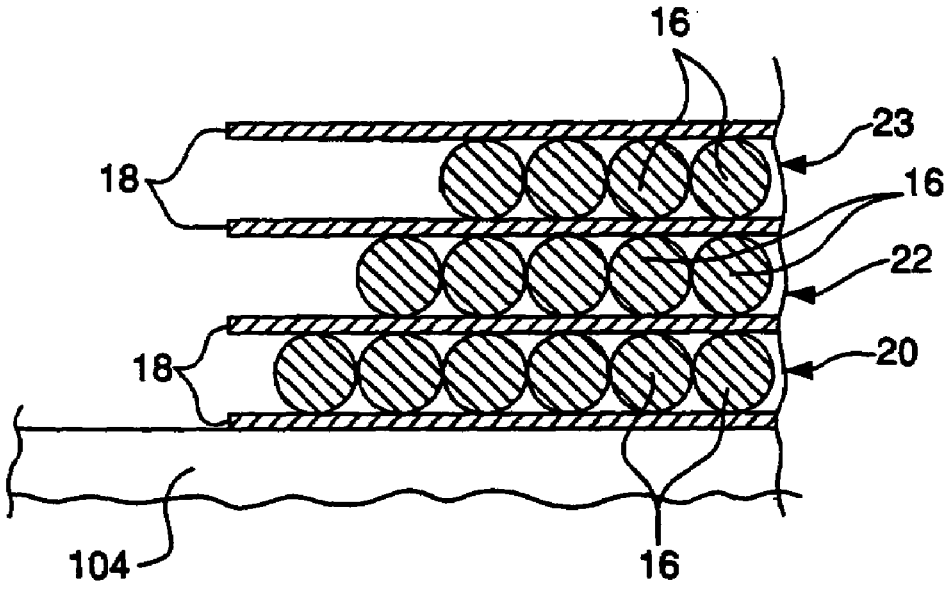
FIG. 5 is a cross-sectional view of the winding shown in FIGS. 2–4, taken through the line "B—B" of FIG. 2.

The above procedures can be repeated until a desired number of layers have been formed in the primary winding 10 (only three of the layers of turns are depicted in FIG. 5, for clarity). The adhesive on the sheets of insulation 18 can subsequently be melted and cured using conventional techniques such as heating the primary winding 10 in a convection oven.

A conventional automated winding machine be programmed to perform the above-described bending and gluing operations. For example, the above-described method has been preformed on an experimental basis using a model AM 3175 layer winding machine available from BR Technologies GmbH.

It may be necessary to flatten the electrical conductor 16 prior to the winding process. This action may be required in applications where the diameter of the electrical conductor 16 is greater than approximately 0.7 mm. Flattening the electrical conductor 16 is believed to further inhibit the potential for the outermost turns to separate from their adjacent turns. (The electrical conductor 16 can be flattened using conventional techniques commonly known to those skilled in the art of transformer design and manufacture.)

It should be noted that a continuous strip of insulating material (not shown) can be used in lieu of the sheets of insulation 18. In particular, the continuous strip of insulating material can be continuously wound ahead of the electrical conductor 16 to provide substantially the same insulating properties as the sheets of insulation 18. The insulating strip can be positioned around a particular layer of the primary winding 10, and then cut to an appropriate length at the end of the layer using conventional techniques commonly known to those skilled in the art of transformer design and manufacture.

Alternative versions of the preferred method can include the technique of lugging. In particular, the portions of the electrical conductor 16 that transition between the various layers of the primary winding 10 can be tied to their adjacent turns, or their adjacent series of turns, using a ribbon 29 (or a string, cord, line, etc.) in a manner commonly known to those skilled in the art of transformer design and manufacture (see FIG. 7). Tying (lugging) the electrical conductor 16 in this manner is believed to reduce the potential for the outermost turns of the primary winding 10 to separate from their adjacent turns.

One of the primary uses for end fill on the insulation of a three-phase transformer winding, such as the primary winding 10, is preventing or inhibiting the outermost turns of the transformer winding from separating from their adjacent turns. Hence, the above-noted techniques for reducing the potential for the outermost turns of the primary winding 10 to separate from their adjacent turns can, under certain circumstances, facilitate the use of insulation without end fill in a three-phase transformer. (Although the above-noted techniques have previously been applied to windings for use in single-phase transformers, it is believed that the techniques, until this point, have not been applied to windings for use in three-phase transformers.)

Moreover, it is currently understood among those skilled in the art of transformer design that adequate short-circuit strength can be obtained in most three-phase transformers without the need for end fill, provided the adhesive on the insulation used in the transformer is properly bonded. Hence, the use of the above-noted techniques can potentially eliminate the additional expense, and the additional storage and manufacturing difficulties sometimes associated with the use of end fill.

Different combinations of the above-noted techniques, it is believed, can facilitate the use of insulation without end fill in a three-phase transformer winding such as the primary winding 10. The proper combination of techniques required to achieve this result depends, at least in part, on the diameter of the electrical conductor 16.

The use of adhesive to form mechanical joints where the electrical conductor 16 transitions between the various layers of the primary winding 10 is believed to be sufficient, by itself, to allow the use of insulation without end fill, where the diameter of the electrical conductor 16 is less than approximately 1.8 mm. In applications where the diameter of the electrical conductor 16 exceeds approximately 1.8 mm, this technique may need to be supplemented with the technique of forming a bend, such as the bend 24, where the electrical conductor 16 transitions between the various layers of the primary winding 10.

The use of lugging is believed to be sufficient, by itself, to allow the use of insulation without end fill regardless of the diameter of the electrical conductor 16. It should be noted, however, each of the above-noted techniques can be supplemented with one or both of the other techniques, regardless of the diameter of the electrical conductor 16, to provide additional protection against the outermost turns of the primary winding 10 dropping off their underlying layers. (It may be necessary to flatten the electrical conductor 16 in applications where the diameter of the electrical conductor 16 is greater than approximately 0.7 mm, as discussed above. This requirement is believed to apply regardless of the combination of the other techniques used to prevent the outermost turns of the primary winding 10 from dropping off their underlying turns.)

The above-described process can be repeated to form the other primary windings 10, and the secondary windings 11.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of the parts, within the principles of the invention.

What is claimed is:

1. A method for forming a winding for a three-phase transformer, comprising:

winding an electrical conductor over a surface of a structure to form a first layer of turns, said structure having opposing end portions and said turns being serially arranged in a direction extending between the opposing end portions;

covering at least a portion of the first layer of turns with a layer of insulating material without end fill;

winding the electrical conductor into a second layer of turns that overlies the first layer of turns and the layer of insulation; and bending the electrical conductor away from the surface of the structure and toward one of the end portions of the structure to form a transition between the first and second layers.

2. The method of claim 1, further comprising securing the transition to at least one of the turns in the first layer of turns.

3. The method of claim 2, wherein securing the transition to at least one of the turns in the first layer of turns comprises adhesively bonding the transition to at least one of the turns in the first layer of turns.

4. The method of claim 2, wherein securing the transition to at least one of the turns in the first layer of turns comprises tying the transition to at least one of the turns in the first layer of turns.

5. The method of claim 1, wherein the bending of the electrical conductor is performed at a first one of the end portions and the electrical conductor is bent toward a second one of the end portions.

6. The method of claim 1, further comprising flattening the electrical conductor before the step of winding the electrical conductor to form the first layer of turns.

7. The method of claim 1, wherein the insulating material comprises a sheet of insulating material.

8. The method of claim 1, wherein the insulating material comprises a strip of insulating material, and wherein the step of covering at least a portion of the first layer of turns with the layer of insulating material comprises winding the strip of insulating material over the first layer of turns such that the layer of insulating material comprises a plurality of turns of the strip of insulating material.

9. The method of claim 1, wherein the bending of the electrical conductor forms an offset between an ending portion of the first layer of turns and a beginning portion of the second layer of turns, said offset being in a direction away from a longitudinal axis of the structure and in a direction coinciding with the longitudinal axis of the structure.

10. The method of claim 1, wherein the structure is a winding leg.

11. The method of claim 1, wherein the structure is a mandrel.

* * * * *